US007278603B2

(12) United States Patent
Drefs et al.

(10) Patent No.: US 7,278,603 B2
(45) Date of Patent: Oct. 9, 2007

(54) METHOD FOR TRANSFERRING A FEED STRIP OF A MATERIAL WEB ONTO A WINDING DEVICE

(75) Inventors: Wolfgang Drefs, Huttlingen (DE); Ewald Wetschenbacher, Zobingen (DE); Zygmund Madrzak, Heidenheim (DE); Jorg Maurer, Steinheim (DE)

(73) Assignee: Voith Paper Patent GmbH (DE)

( * ) Notice: Subject to any disclaimer, the term of this patent is extended or adjusted under 35 U.S.C. 154(b) by 358 days.

(21) Appl. No.: 10/522,559

(22) PCT Filed: Jul. 15, 2003

(86) PCT No.: PCT/EP03/50306

§ 371 (c)(1),
(2), (4) Date: Jan. 27, 2005

(87) PCT Pub. No.: WO2004/013023

PCT Pub. Date: Feb. 12, 2004

(65) Prior Publication Data

US 2006/0006273 A1 Jan. 12, 2006

(30) Foreign Application Priority Data

Jul. 31, 2002 (DE) ..... 102 34 958

(51) Int. Cl.
*B65H 18/14* (2006.01)

(52) U.S. Cl. ..... 242/541.4; 242/541.5; 242/541.6; 242/541.7

(58) Field of Classification Search ..... 242/541, 242/541.4–541.7, 547
See application file for complete search history.

(56) References Cited

U.S. PATENT DOCUMENTS

| | | | | |
|---|---|---|---|---|
| 4,171,107 | A * | 10/1979 | Kayser et al. | 242/541.6 |
| 6,311,922 | B1 * | 11/2001 | Beisswanger et al. | 242/542.3 |
| 6,402,082 | B1 * | 6/2002 | Madrzak et al. | 242/541.4 |
| 6,536,705 | B1 * | 3/2003 | Bock | 242/541.4 |
| 6,575,396 | B2 * | 6/2003 | Leskinen | 242/541.4 |
| 6,604,703 | B2 * | 8/2003 | Beisswanger et al. | 242/541.4 |
| 2001/0052560 | A1 | 12/2001 | Beisswanger et al. | |

FOREIGN PATENT DOCUMENTS

| | | |
|---|---|---|
| DE | 198 22 261 A | 11/1999 |
| DE | 198 52 257 A1 | 5/2000 |
| DE | 199 39 506 A1 | 2/2001 |
| DE | 100 30 199 A1 | 1/2002 |
| EP | 0 483 092 B1 | 4/1992 |
| WO | WO 98/52858 | 11/1998 |

* cited by examiner

*Primary Examiner*—Peter M. Cuomo
*Assistant Examiner*—Sang Kim
(74) *Attorney, Agent, or Firm*—Hershkovitz & Associates; Abe Hershkovitz

(57) ABSTRACT

A winding apparatus for transferring a web from a carrier drum to a spool. Pressure between the spool and the carrier drum is higher in the area of the feed strip of the web by applying a higher contact force, or by orienting the spool and drum at an angle to one another.

35 Claims, 2 Drawing Sheets

METHOD FOR TRANSFERRING A FEED STRIP OF A MATERIAL WEB ONTO A WINDING DEVICE

CROSS-REFERENCE TO RELATED APPLICATIONS

The present application is a National Stage Application of International Application No. PCT/EP2003/050306, filed Jul. 15, 2003. Further, the present application claims priority under 35 U.S.C. 119 of German application DE 102 34 958.4, filed Jul. 31, 2002.

BACKGROUND OF THE INVENTION

1. Field of the Invention

The invention relates to a method for transferring a feed strip of a material web, in particular a paper or cardboard web, onto a winding device for winding the material web onto a spool, in which the material web or the feed strip is led over a carrier drum and a winding nip is formed between the carrier drum and the spool. It further relates to a winding apparatus for winding a material web, in particular a paper or board web, onto a spool, in which the material web is led over a carrier drum and a winding nip is formed between the carrier drum and the spool.

2. Discussion of Background Information

Winding devices of the aforementioned type are known, for example from the documents DE 198 22 261 A1, DE 198 52 257 A1, DE 199 39 506 A1, WO 98/52858 and EP 0 483 092 B1.

The previous general sequence of a corresponding feed operation in a papermaking machine comprises the following steps:

At the end of the drying section, that is to say on the last drying cylinder, the paper web is run at full width into the pulper.

A strip is cut, for example by means of a tip cutter.

The strip is taken off the last drying cylinder and transferred to a winding device or reel-up by means of a rope guide, vacuum tapes, air plate and/or the like.

The strip is raised up and pulled tight.

The strip is run to the full web width.

In this case, the clamping point used for the strip is the winding nip or nip formed between a carrier drum and an empty spool.

The line force in the nip is produced by pressing, the empty spool being pressed appropriately against the carrier drum or the carrier drum being pressed appropriately against the empty spool.

Pressing the empty spool against the carrier drum or the carrier drum against the empty spool is usually carried out by means of two hydraulic cylinders, one of which is provided on the operator side and one on the drive side and which are acted on with the same pressure. The result of the uniform pressing or identical pressing force on the operator side and the drive side is a nip which is closed over its entire width.

Moreover, in general a feed position has hitherto been provided on the rail or between the changeover position and the horizontal position on the rail. The distribution of the line force has hitherto generally depended on the following variables:

level of the pressing force changeover position (changeover angle)

rigidity of carrier drum and spool design of the surfaces of carrier drum and spool (steel, rubber covering, hardness)

diameter of carrier drum and spool.

In this case, the distribution of the line force or pressure with respect to the center of the machine has hitherto always been symmetrical.

During the feeding or transfer of the feed strip, problems can occur in particular in the case of a rubber-covered carrier drum that has shrunk. For example, a carrier drum that has shrunk signifies a reduction in diameter. The nip force or pressure is lower at the relevant point, in the extreme case it being possible for the nip even to be open at the relevant point, that is to say no longer fully closed. The transfer strip can then no longer be gripped.

SUMMARY OF THE INVENTION

According to the invention, there is provided an improved method and an improved winding device in which the aforementioned problems are eliminated. In this case, the intention is in particular to ensure that the winding nip or nip is in every case closed at the point at which the transfer strip arrives.

With respect to the method, according to the invention, the line force in the winding nip is set to a higher value in the region of the feed strip than in the remaining region of the winding nip during the transfer of the feed strip.

If the feed strip is led through the winding nip in one of the two lateral edge regions, then the line force is preferably set to a higher value in the relevant lateral edge region of the winding nip than in the other lateral edge region. In this case, the line force in the other lateral edge region can even be set to the value zero.

According to a practical refinement of the method according to the invention, the line force on the operator side and on the drive side of the winding nip are set to different values, with a higher value on the side of the feed strip.

The line force in the winding nip can be set, for example, via a movable or displaceable spool and/or via a movable or adjustable carrier drum.

If the line force in the winding nip is set via a movable or displaceable spool, then, advantageously, the spool is pressed more firmly against the carrier drum in the region of the feed strip than in the remaining region of the winding nip.

The spool can also be set obliquely with respect to the carrier drum.

A stationary carrier drum is expediently used.

The feed strip can be fed to the winding device in the primary region or in the secondary region, for example. What is to be understood by such a primary and secondary region of the winding device is familiar to those skilled in the art and, for example, may be gleaned from the documents mentioned on page 1 of the instant specification. For example, a new spool can be provided in the primary region and brought into a spool changing position, in which it forms a new winding nip with the carrier drum. For this purpose, for example, a primary transport device can be provided. Then, for example, a secondary transport device can take over the new spool with the started new wound reel.

The invention can therefore be applied, for example, in a winding device as is described in EP 0 483 092 B1 and in which the line force in the winding nip can be set via a movable or displaceable spool. The content of this document is hereby incorporated by reference in the content of the present application.

According to an alternative expedient refinement of the method according to the invention, the line force in the winding nip is set via a movable or displaceable carrier drum.

If the line force in the winding nip is set via a movable or displaceable carrier drum, then the carrier drum is preferably pressed more firmly against the spool in the region of the feed strip than in the remaining region of the winding nip.

The carrier drum is expediently set obliquely with respect to the spool.

The spool can in particular be stationary or movable in order to compensate for the increase in the winding diameter.

The feed strip can be fed to the winding device either in the primary region or in the secondary region.

The invention can therefore also be applied in a winding device as is described for example in WO 98/52858 and in which the line force in the winding nip can be set via a movable or displaceable spool.

By the method according to the invention, secure closure of the winding nip at which the feed strip arrives is ensured. In most cases, the feed strip will be supplied on the operator side. Corresponding reliable closure of the nip is achieved in particular by pressing more firmly at the relevant point of the winding nip, it being possible for the winding nip on the opposite side even to be opened, that is to say on the opposite side the line force can even be reduced to the value zero.

Care is therefore taken to have an asymmetrical distribution of the line force, it being possible in particular for the line force on the operator side to be different from that on the drive side.

On the side facing away from the feed strip, the carrier drum or the spool can be set obliquely. On the side facing away from the feed strip, for example on the drive side, the result is then a zero line force.

In the case in which the line force in the winding nip can be set via a movable or displaceable carrier drum, the procedure can be as follows.

In order to open the side of the nip facing away from the feed strip, the carrier drum is set obliquely. This can be done as follows, for example:

- The carrier drum is moved away, for example hydraulically via cylinders for pressing on the carrier drum, it being possible for the position of the empty spool in the primary arm of the primary mounting to be fixed.
- Alternatively, the carrier drum can be moved away via an additional cylinder.
- The spool can be moved away, for example, via an electric drive, for example a servomotor or the like. The carrier drum on the relevant side can move against a stop.

The feed strip can be fed, for example, in the primary region (position of the empty spool fixed in the primary arm) or in the secondary region (position of the entry spool given by secondary carriage).

In the case of feeding in the primary region, the carrier drum can be moved away, for example hydraulically via cylinders for pressing on the carrier drum, on the side facing away from the feed strip, for example the drive side, which results in a corresponding gap. It is also possible for the carrier drum on the side facing away from the feed strip, for example the drive side, to move against a stop, which likewise again results in a corresponding gap.

In the case of feeding the feed strip in a secondary region, the carrier drum can be moved away, for example hydraulically via cylinders for pressing on the carrier drum on the side facing away from the feed strip, in particular the drive side, which results in a corresponding gap. It is also possible for the secondary carriage to be moved away on the side facing away from the feed strip, for example the drive side, to such an extent that the carrier drum on the side facing away from the strip moves against a stop, which again results in a corresponding gap.

Even if the line force in the winding nip can be set via a movable or displaceable spool, the feeding can, for example, again be carried out in the primary region or in the secondary region of the winding device.

In the case of feeding in the primary region (empty spool clamped in the primary carriage/primary carriage movable relative to the primary arm of the primary mounting), for example the following steps are conceivable:

- The primary carriage is moved away, for example hydraulically, on the side facing away from the feed strip, for example the drive side, which results in a corresponding gap.
- The primary carriage is moved against a stop, which again results in a corresponding gap.

In the case of such feeding in the primary region, in general the spool holder can be opened somewhat.

In the case of feeding in the secondary region (empty spool clamped in the secondary carriage), in the present case of exerting a corresponding influence on the line force via the movable or displaceable spool, the procedure can be as follows, for example:

- The secondary carriage is moved away, for example hydraulically, from the carrier drum on the side facing away from the feed strip, for example on the drive side, which results in a corresponding gap.
- The secondary carriage is moved against a stop, which results in a corresponding gap.

In the case of feeding in the secondary region (empty spool pressed against carrier drum by way of secondary levers), the procedure can also be as follows, for example:

- The secondary lever is not applied completely, in order to obtain an appropriate gap.
- The secondary lever is moved against a stop in order to obtain an appropriate gap.

In the case of feeding in the secondary region, in the case of exerting an appropriate influence on the line force via a movable or displaceable spool, the procedure can therefore be such, for example, that the secondary lever or secondary carriage is not applied completely, from which it follows that the empty spool does not rest on completely.

The winding device according to the invention is accordingly characterized in that, in order to transfer a feed strip of the material web, the line force in the winding nip can be set to a higher value in the region of the feed strip than in the remaining region of the winding nip.

According to one aspect of the invention, there is provided a method for transferring a feed strip of a web, made of one of paper or cardboard, onto a winding device for winding the web onto a spool, the method comprising leading the feed strip over a carrier drum, forming a winding nip between the carrier drum and the spool, and setting a line force in the winding nip at a higher value in the region of the feed strip than in the remaining region of the winding nip during transfer of the feed strip.

The method according to the invention may further comprise leading the feed strip through the winding nip in one of two lateral edge regions of the winding nip and setting the line force to a higher value in one edge region of the winding nip than in another lateral edge region. Additionally, the method may comprise setting the line force in another lateral edge region to the value zero.

According to the invention, the winding nip includes a drive side and an operator side and the method may further comprise setting the line force on the operator side and on the drive side of the winding nip to different values. Furthermore, the method may comprise one of, moving and displacing the spool to set the line force. Additionally, the method may comprise pressing the spool more firmly against the carrier drum in the region of the feed strip than in the remaining region of the winding nip. The spool may be arranged obliquely with respect to the carrier drum. Furthermore, the carrier drum may be made stationary.

Additionally, according to the invention the feed strip may be fed in a primary region of the winding device. Alternatively, the feed strip may be fed in a secondary region of the winding device. The carrier drum may be moved to set the line force in the winding nip. According to the invention, the carrier drum may be pressed more firmly against the spool in the region of the feed strip than in the remaining region of the winding nip. The carrier drum may be arranged obliquely with respect to the spool. The spool may be stationary. Alternatively, the spool may be movable in order to compensate for the increase in the winding diameter.

According to another aspect of the invention, a winding device for winding a web, made of one of paper or cardboard, comprises a spool onto which the web is to be wound, a carrier drum over which the web is led, the spool and drum being in contact to form a line of force along a winding nip. The web has a feed strip for transferring the web from the carrier to the spool, and the line force in the winding nip is set to a higher value in the region of the feed strip than in the remaining region of the winding nip. The winding device may further comprise two lateral edge regions on the winding nip, the feed strip being led through one of the two lateral edge regions, the line force being higher in the one edge region of the winding nip than in the other lateral edge region. The winding device may comprise a line force in the other lateral edge region which is set to the value zero. The winding nip may include an operator side and a drive side. The spool may be one of, movable and displaceable to set the line force. The line force may be greater in the region of the feed strip than in the remaining region of the winding nip. The spool may be set obliquely with respect to the carrier drum. The carrier drum may be stationary. The winding device may further comprise a primary and a secondary winding region, the feed strip being fed in the primary winding region of the winding device. Alternatively, the feed strip may be fed in the secondary winding region of the winding device.

According to yet another aspect of the invention, a method for transferring a feed strip of a web, made of one of paper or cardboard, onto a winding device for winding the web onto a spool, comprises leading the feed strip over a carrier drum, forming a winding nip between the carrier drum and the spool, setting a line force in the winding nip at a higher value in the region of the feed strip than in the remaining region of the winding nip during transfer of the feed strip, and leading the feed strip through the winding nip in one of two lateral edge regions of the winding nip. The winding nip includes a drive side and an operator side and further comprises setting the line force on the operator side and on the drive side of the winding nip to different values, the method further comprising pressing the spool more firmly against the carrier drum in the region of the feed strip than in the remaining region of the winding nip.

According to the invention, a winding device for winding a web, made of one of paper or cardboard, comprises a spool onto which the web is to be wound, a carrier drum over which the web is led, the spool and drum being in contact to form a line of force along a winding nip, the web having a feed strip for transferring the web from the carrier to the spool, wherein the line force in the winding nip is set to a higher value in the region of the feed strip than in the remaining region of the winding nip. The feed strip is led through one of two lateral edge regions on the winding nip, the line force being higher in the one edge region of the winding nip than in the other lateral edge region, wherein the winding nip includes an operator side and a drive side, and the spool is one of, movable and displaceable to set the line force.

BRIEF DESCRIPTION OF THE DRAWINGS

The invention will be described in more detail in the following text using an exemplary embodiment and with reference to the drawing, in which.

DETAILED DESCRIPTION OF THE INVENTION

Figure 1:
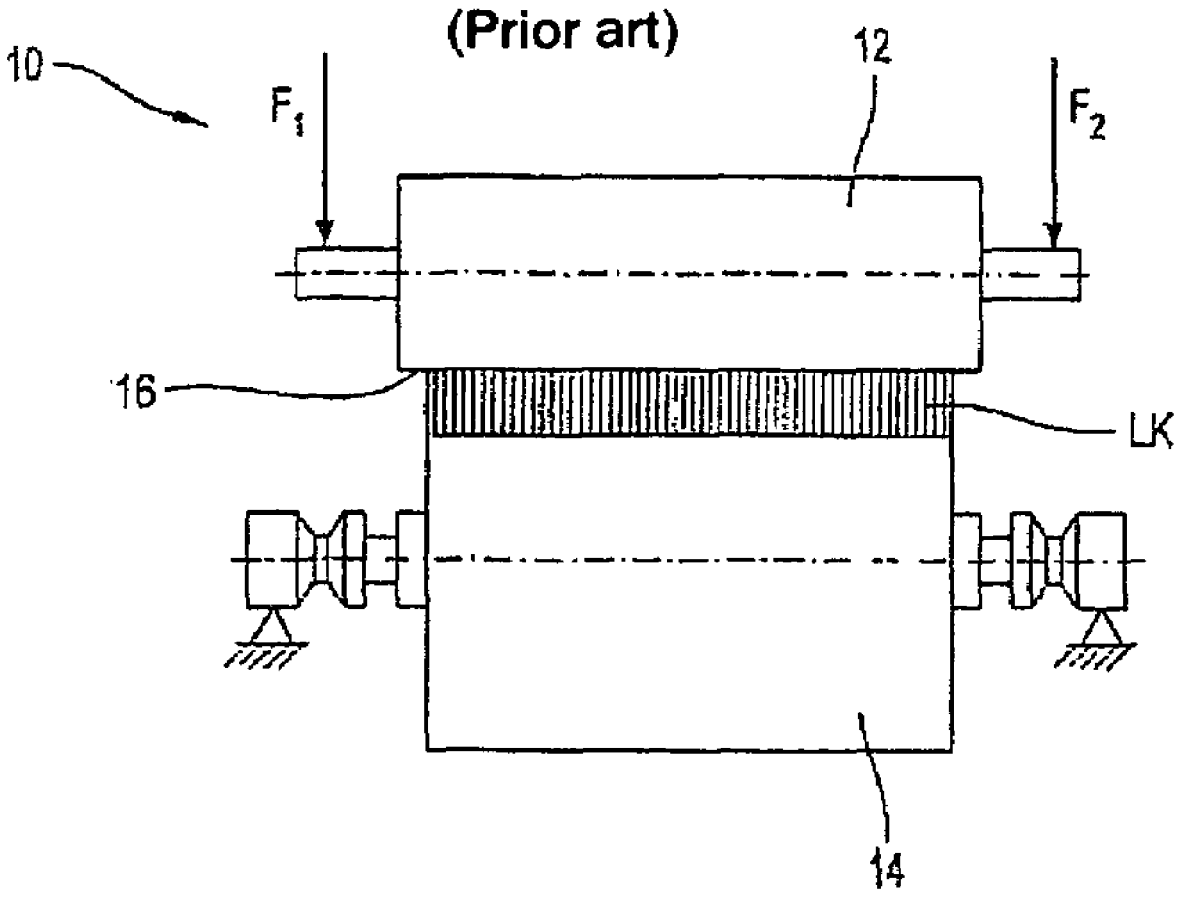
FIG. 1 shows a schematic plan view of a winding device according to the prior art, in which a movable or displaceable carrier drum is pressed against the spool with equally high pressing forces on the two sides until the feed strip is transferred.

FIG. 1 shows a schematic plan view of the winding device 10 according to the prior art, in which a movable or displaceable carrier drum 12 is pressed against the spool 14 with equally high pressing forces $F_1$, $F_2$ on the two sides during the transfer of the feed strip. The result is thus a symmetrical distribution of the line force LK in the nip or winding nip 16 formed between the carrier drum 12 and the spool 14.

Figure 2:
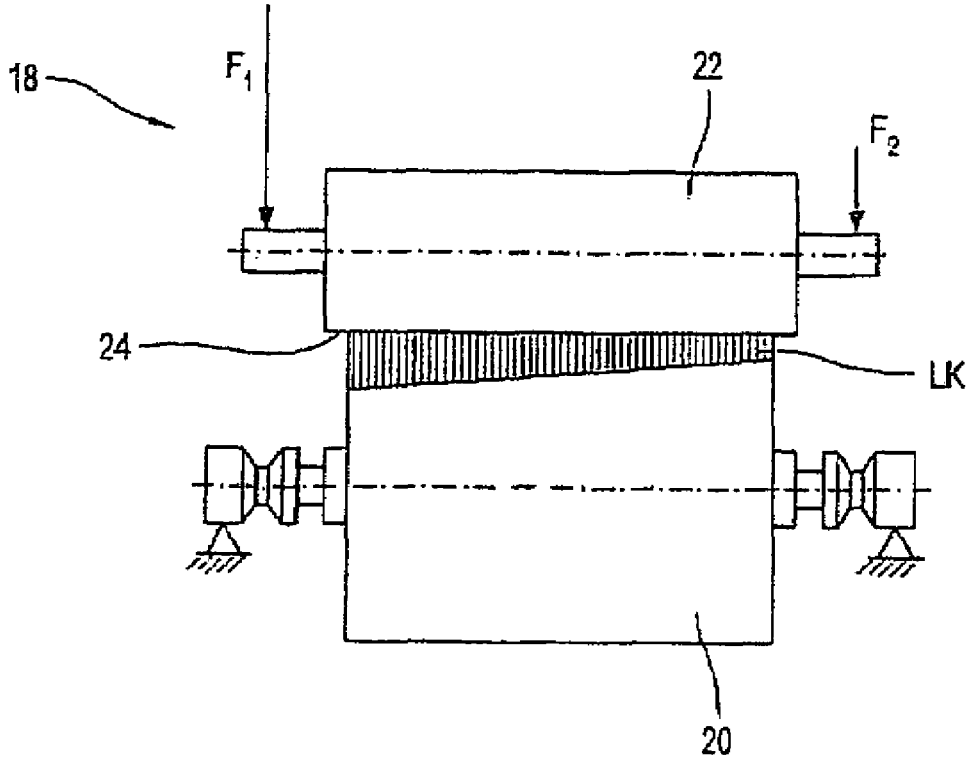
FIG. 2 shows a schematic plan view of a winding device according to the invention, in which the movable or displaceable carrier drum is pressed against the spool with a higher pressing force on the side of the feed strip than on the other side, in each case a pressing force greater than zero being produced on both sides.

FIG. 2 shows a schematic plan view of an exemplary embodiment of a winding device 18 according to the invention for winding a material web, in particular a paper or cardboard web, onto a spool 20, in which the material web or the feed strip is again led over a carrier drum 22 and a winding nip 24 is formed between the carrier drum 22 and the spool 20.

In the present exemplary embodiment of the winding device 18 according to the invention, the movable displaceable carrier drum 22 is pressed against the spool 20 with a higher pressing force $F_1$ on the side of the feed strip than on the other side. In the present case, a pressing force greater than zero is produced on the two sides in each case, which means that even the pressing force $F_2$ on the side facing away from the feed strip, which is smaller as compared with the pressing force $F_1$, is still greater than zero.

Figure 3:
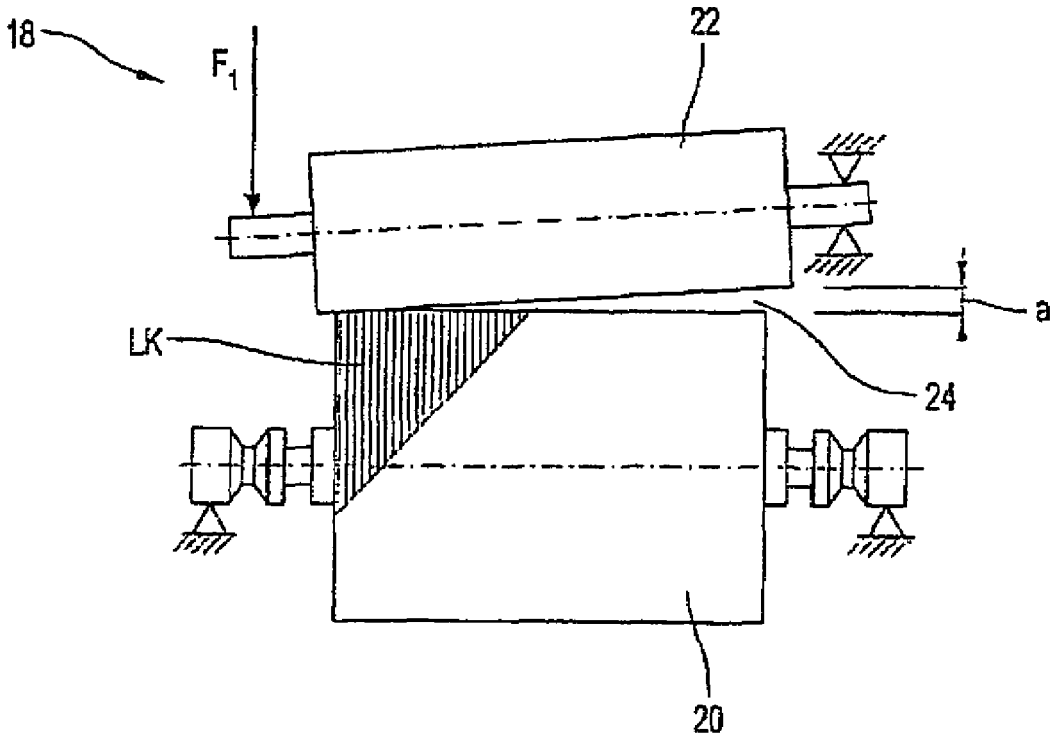
FIG. 3 shows a schematic plan view of a further embodiment of the winding device according to the invention, but in the present case the carrier drums being set obliquely, that is to say the winding nip on the side facing away from the feed strip being opened, so that the pressing force on this side is reduced to zero.

FIG. 3 shows a schematic plan view of a further embodiment of the winding device 18 according to the invention.

In FIG. 3, the carrier drum 22 is set obliquely with respect to the spool 20, however, so that the carrier drum 22 is only pressed against the spool 20 with the pressing force $F_1$ on the side of the feed strip, while the winding nip 24 on the side facing away from the feed strip is opened by the amount a, so that the pressing force is reduced to zero on this side.

In the case of FIG. 3, the result is thus again an asymmetrical distribution of the line force LK.

LIST OF DESIGNATIONS

10 Winding device
12 Carrier drum
14 Spool
16 Winding nip, nip
18 Winding device
20 Spool
22 Carrier drum
24 Winding nip, nip
LK Line force
a Amount

The invention claimed is:

1. A method for transferring a feed strip of a web, made of one of paper or cardboard, onto a winding device for winding the web onto a spool, the method comprising:

leading the feed strip over a carrier drum;

forming a winding nip between the carrier drum and the spool; and setting a line force in the winding nip to produce a distribution of the line force over a width of the nip, the line force being set at a higher value in the region of the feed strip than in the remaining region of the winding nip the line force being produced by at least one of, pressing the spool against the carrier drum and the carrier drum being pressed against the spool; and maintaining the line force in the winding nip at the higher value in the region of the feed strip than in the remaining region during transfer of the feed strip onto the winding device.

2. The method of claim 1, further comprising:

leading the feed strip through the winding nip in one of two lateral edge regions of the winding nip; and setting the line force to a higher value in one edge region of the winding nip than in another lateral edge region.

3. The method of claim 2, further comprising:

setting the line force in said another lateral edge region to the value zero.

4. The method of claim 2, wherein the winding nip includes a drive side and an operator side and further comprising setting the line force on the operator side and on the drive side of the winding nip to different values.

5. The method of claim 1, further comprising one of, moving and displacing the spool to set the line force.

6. The method of claim 5, further comprising:

pressing the spool more firmly against the carrier drum in the region of the feed strip than in the remaining region of the winding nip.

7. The method of claim 5, further comprising:

arranging the spool obliquely with respect to the carrier drum.

8. The method of claim 5, further comprising:

making the carrier drum stationary.

9. The method of claim 5, further comprising:

feeding the feed strip in a primary region of the winding device.

10. The method of claim 5, further comprising:

feeding the feed strip in a secondary region of the winding device.

11. The method of claim 1, further comprising:

moving the carrier drum to set the line force in the winding nip.

12. The method of claim 11, further comprising:

pressing the carrier drum more firmly against the spool in the region of the feed strip than in the remaining region of the winding nip.

13. The method of claim 11, further comprising:

arranging the carrier drum obliquely with respect to the spool.

14. The method of claim 11, wherein the spool is stationary.

15. The method of claim 11, wherein the spool is movable in order to compensate for the increase in the winding diameter.

16. The method of claim 11, further comprising:

feeding the feed strip in a primary region of the winding device.

17. The method of claim 11, further comprising:

feeding the feed strip in a secondary region of the winding device.

18. A winding device for winding a web, made of one of paper or cardboard, the winding device comprising:

a spool onto which the web is to be wound;

a carrier drum over which the web is led;

the spool and drum being in contact to form a line of force along a winding nip;

said web having a feed strip for transferring said web from the carrier drum to the spool, and wherein the line force in the winding nip is set to a higher value in the region of the feed strip than in the remaining region of the winding nip whereby the line force in the winding nip is maintained at the higher value in the region of the feed strip than in the remaining region during transfer of the feed strip onto the winding device.

19. The winding device as claimed in claim 18, further comprising:

two lateral edge regions on said winding nip, said feed strip being led through one of the two lateral edge regions, the line force being higher in said one edge region of the winding nip than in the other lateral edge region.

20. The winding device as claimed in claim 19, wherein the line force in said other lateral edge region is set to the value zero.

21. The winding device as claimed in claim 19, wherein the winding nip includes an operator side and a drive side.

22. The winding device as claimed in claim 18, wherein said spool is one of, movable and displaceable to set the line force.

23. The winding device as claimed in claim 22, wherein the line force is greater in the region of the feed strip than in the remaining region of the winding nip.

24. The winding device as claimed in claim 22, wherein the spool is set obliquely with respect to the carrier drum.

25. The winding device as claimed in claim 22, wherein the carrier drum is stationary.

26. The winding device as claimed in claim 22, further comprising a primary and a secondary winding region, the feed strip being fed in the primary winding region of the winding device.

27. The winding device as claimed in claim 22, further comprising a primary and a secondary winding region, the feed strip being fed in the secondary winding region of the winding device.

28. The winding device as claimed in claim 18, wherein the carrier drum is one of, movable and displaceable to set the line force in the winding nip.

29. The winding device as claimed in claim 28, wherein the line force is greater in the region of the feed strip than in the remaining region of the winding nip.

30. The winding device as claimed in claim 28, wherein the carrier drum is set obliquely with respect to the spool.

31. The winding device as claimed in claim 28, wherein the spool is stationary.

32. The winding device as claimed in claim 28, wherein the feed strip is fed in a primary region of the winding device.

33. The winding device as claimed in claim 28, wherein the feed strip is fed in a secondary region of the winding device.

34. A method for transferring a feed strip of a web, made of one of paper or cardboard, onto a winding device for winding the web onto a spool, the method comprising:

leading the feed strip over a carrier drum;

forming a winding nip between the carrier drum and the spool;

setting a line force in the winding nip at a higher value in the region of the feed strip than in the remaining region of the winding nip;

maintaining the line force in the winding nip at the higher value in the region of the feed strip than in the remaining region during transfer of the feed strip;

leading the feed strip through the winding nip in one of two lateral edge regions of the winding nip;

the winding nip including a drive side and an operator side and further comprising setting the line force on the operator side and on the drive side of the winding nip to different values; and pressing the spool more firmly against the carrier drum in the region of the feed strip than in the remaining region of the winding nip.

35. A winding device for winding a web, made of one of paper or cardboard, the winding device comprising:

a spool onto which the web is to be wound;

a carrier drum over which the web is led;

the spool and drum being in contact to form a line of force along a winding nip;

said web having a feed strip for transferring said web from the carrier drum to the spool, wherein the line force in the winding nip is set to a higher value in the region of the feed strip than in the remaining region of the winding nip;

said feed strip being led through one of two lateral edge regions on said winding nip, the line force being higher in said one edge region of the winding nip than in the other lateral edge region and the higher line force being maintained in the one edge region of the winding nip, wherein the winding nip includes an operator side and a drive side, and said spool being one of, movable and displaceable to set the line force.

* * * * *